US009170524B2

(12) United States Patent
Nagatoshi et al.

(10) Patent No.: US 9,170,524 B2
(45) Date of Patent: Oct. 27, 2015

(54) IMAGE FORMING APPARATUS FOR DETERMINING A TIME TO START FORMING AN IMAGE

(71) Applicant: CANON KABUSHIKI KAISHA, Tokyo (JP)

(72) Inventors: Jun Nagatoshi, Tokyo (JP); Akihiro Fukutomi, Tokyo (JP); Daisuke Miyagawa, Kawasaki (JP); Naoki Inoue, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/528,445

(22) Filed: Oct. 30, 2014

(65) Prior Publication Data

US 2015/0055967 A1 Feb. 26, 2015

Related U.S. Application Data

(63) Continuation of application No. 14/224,566, filed on Mar. 25, 2014, now Pat. No. 8,902,271.

(30) Foreign Application Priority Data

Mar. 29, 2013 (JP) ..... 2013-073277
Mar. 11, 2014 (JP) ..... 2014-047769

(51) Int. Cl.
*G03G 15/043* (2006.01)
*B41J 2/47* (2006.01)

(52) U.S. Cl.
CPC ..... *G03G 15/0435* (2013.01); *B41J 2/471* (2013.01)

(58) Field of Classification Search
CPC ..... G03G 15/0435; B41J 2/471
USPC ..... 347/224, 225, 261
See application file for complete search history.

(56) References Cited

U.S. PATENT DOCUMENTS

2010/0225729 A1* 9/2010 Fujise et al. ..... 347/224

FOREIGN PATENT DOCUMENTS

JP 2001-096799 A 4/2001
JP 2004-322527 A 11/2004

* cited by examiner

*Primary Examiner* — Sarah Al Hashimi
(74) *Attorney, Agent, or Firm* — Canon USA Inc. IP Division

(57) ABSTRACT

The image forming apparatus includes a determination unit configured to determine whether or not a polygon mirror has converged to the number of rotations that allows image formation to be performed, and the determination unit is capable of detecting a first timing and a second timing and determines that the polygon mirror has converged to a number of rotations that allows the image formation to be performed based on an earlier one of the first timing and the second timing.

15 Claims, 7 Drawing Sheets

IMAGE FORMING APPARATUS FOR DETERMINING A TIME TO START FORMING AN IMAGE

CROSS REFERENCE TO RELATED APPLICATIONS

The present application is a Continuation of U.S. patent application Ser. No. 14/224,566 filed Mar. 25, 2014, which claims the benefit of priority from Japanese Patent Application No. 2013-073277, filed Mar. 29, 2013, and Japanese Patent Application No. 2014-047769, filed Mar. 11, 2014, which are each hereby incorporated by reference herein in their entirety.

BACKGROUND OF THE INVENTION

1. Field of the Invention

The present disclosure generally relates to image forming and, more particularly, to image forming apparatuses such as a laser beam printer (LBP), a digital copier, and a digital facsimile (FAX) which perform optical writing by using laser beams.

2. Description of the Related Art

In an electrophotographic type image forming apparatus, a laser beam emitted from a laser light source is reflected by a rotating polygon mirror so that the laser beam modulated through an image signal scans a surface of a photosensitive member. In many image forming apparatuses, the polygon mirror is being stopped while a user does not provide an instruction for a print operation, and a scanner motor that rotates the polygon mirror starts being driven upon the user instructing the print operation to be started.

Japanese Patent Laid-Open No. 2001-96799 discusses the following method. That is, after a scanner motor is started, an image forming apparatus stands by for a predetermined period of time in which it is estimated that the number of rotations of a rotatable polygon mirror converges at the number of rotations that allows exposure to be performed (i.e., that allows an image to be formed on a recording material) after the number of rotations of the rotatable polygon mirror has reached a predetermined number of rotations. Then, the determination of a scanner ready state (i.e., the number of rotations of the rotatable polygon mirror has reached a level that allows an image to be formed on a recording material) is made. Here, the estimated predetermined period of time is selected on the basis of the time it takes for the cycle of rotations to reach a predetermined value.

However, in the method discussed in Japanese Patent Laid-Open No. 2001-96799, the predetermined period of time in which it is estimated that the number of rotations of the rotatable polygon mirror reaches the level that allows exposure to be performed needs to be set to a period of time with some margins while taking an error arising due to a variation in an operating environment or a component into consideration. In addition, the image forming apparatus always stands by for the predetermined period of time after the number of rotations of the rotatable polygon mirror has reached the predetermined value. Thus, there may be a case in which a timing at which the determination of an exposure ready state is unnecessarily delayed by continuing to stand by for the predetermined period of time while the number of rotations of the rotatable polygon mirror has actually converged at the level that allows exposure to be performed. In such a case, there may be a case in which a timing at which an image starts to be formed on a recording material is unnecessarily delayed as well. As a result, a first print output time (FPOT), which is the time it takes for an image to finish being formed on a first piece of the recording material after an instruction for the image to start being formed is received, may be unnecessarily extended, and the user may need to wait for the extended period of time.

SUMMARY OF THE INVENTION

The present disclosure is an enhancement of the existing technique described above and is directed to suppressing a delay in a timing at which an image starts to be formed on a recording material.

According to an aspect of the present disclosure, provided is an image forming apparatus that includes an image forming unit and a determination unit. The image forming unit includes a photosensitive member, a rotatable polygon mirror, and a light source configured to irradiate the polygon mirror with light, and is configured to irradiate the photosensitive member with the light reflected by the polygon mirror so as to form a latent image on the photosensitive member and to perform image formation based on the latent image. The determination unit is configured to determine whether or not the polygon mirror has converged at a number of rotations that allows the image formation to be performed. In such an image forming apparatus, the image forming unit starts the image formation based on the determination unit determining that the polygon mirror has converged at the number of rotations that allows the image formation to be performed. In addition, the determination unit is capable of detecting a first timing and a second timing and determines that the polygon mirror has converged at the number of rotations that allows the image formation to be performed based on an earlier one of the first timing and the second timing. Here, the first timing corresponds to a timing at which a preset first period of time has elapsed after a number of rotations of the polygon mirror has reached a first number of rotations, and the second timing corresponds to a timing at which a preset second period of time, which is shorter than the first period of time, has elapsed while the number of rotations of the polygon mirror stays within a range that is from a second number of rotations to a third number of rotations inclusive.

Further features of the present disclosure will become apparent from the following description of exemplary embodiments with reference to the attached drawings.

DESCRIPTION OF THE EMBODIMENTS

First Exemplary Embodiment

Image Forming Apparatus

Figure 1:
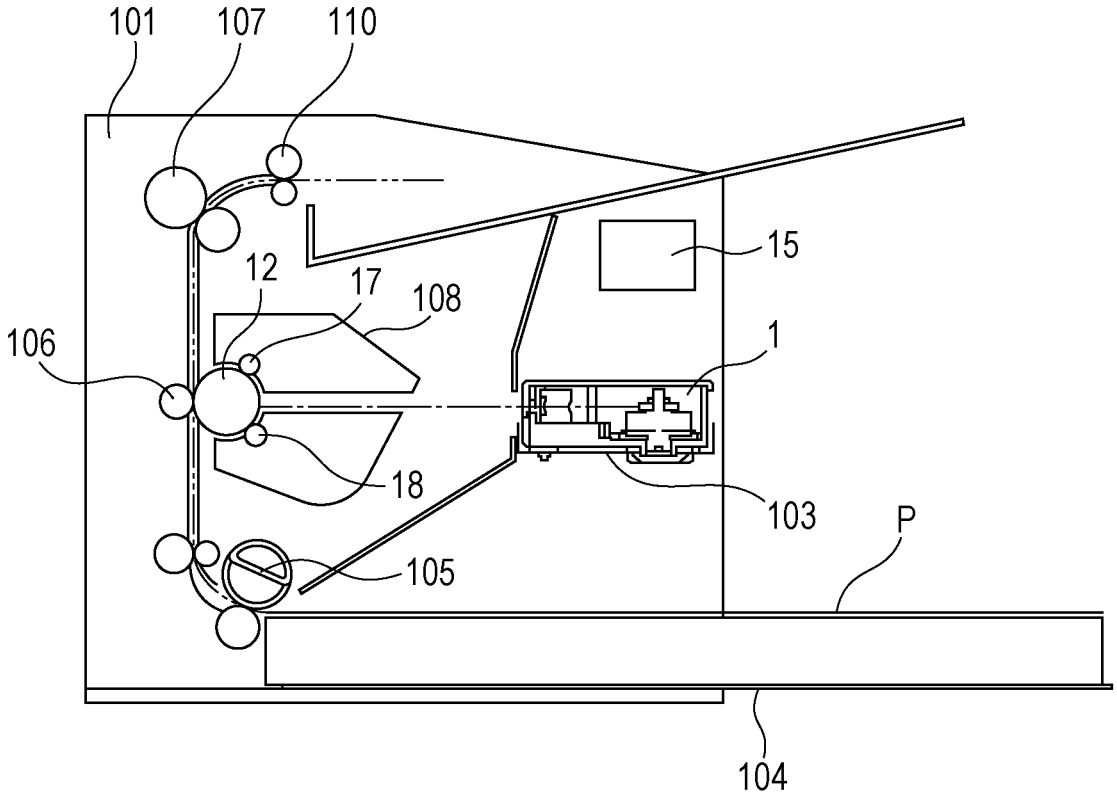
FIG. 1 is a schematic sectional view of an image forming apparatus.

An image forming apparatus 101 will first be described. FIG. 1 illustrates the image forming apparatus 101 according to a first exemplary embodiment. The image forming apparatus 101 includes an optical scanning device 1, which will be described later. The optical scanning device 1 is mounted on an optical bench 103. The optical bench 103 partially constitutes a housing of the image forming apparatus 101. The image forming apparatus 101 further includes a paper feeding unit 104 on which a recording material (paper) P is to be placed, a paper feeding roller 105, a transfer roller 106 serving as a transfer device, and a fixing unit 107 serving as a fixing device, and a process cartridge 108 is disposed at a location opposing the transfer roller 106. The process cartridge 108 is provided with a photosensitive drum (photosensitive member) 12 serving as an image forming device, a charging roller (charging device) 17, and a developing roller (developing device) 18. As used herein, the term "unit" generally refers to any combination of software, firmware, hardware, or other component that is used to effectuate a purpose.

The surface of the photosensitive drum 12 is charged by the charging roller 17 while the photosensitive drum 12 rotates, and an electrostatic latent image is then formed on the photosensitive drum 12 by the optical scanning device 1 on the basis of image data. Thereafter, toner is adhered to the photosensitive drum 12 by the developing roller 18 so as to develop the electrostatic latent image, and thus a toner image is formed on the photosensitive drum 12. The recording material P is fed from the paper feeding unit 104 by the paper feeding roller 105, and the toner image formed on the photosensitive drum 12 is transferred to the recording material P by the transfer roller 106. The recording material P is then heated and pressurized by the fixing unit 107, and the toner image is thus fixed to the recording material P. The recording material P to which the toner image has been fixed is outputted from the image forming apparatus 101 by discharge rollers 110. The photosensitive drum 12, the charging roller 17, the developing roller 18, the optical scanning device 1, the paper feeding unit 104, the paper feeding roller 105, the transfer roller 106, and the fixing unit 107 described above are included in an image forming unit 100 (refer to FIG. 3B) that is configured to form an image on the recording material P. Note that the image forming unit 100 further includes an image processing unit (not illustrated) that subjects print data transmitted from a host computer or the like (not illustrated) to image processing so as to generate image data to be used by the optical scanning device 1 to form a latent image. The operation of the image forming unit 100 is controlled by a control unit 15.

Optical Scanning Device

Figure 2:
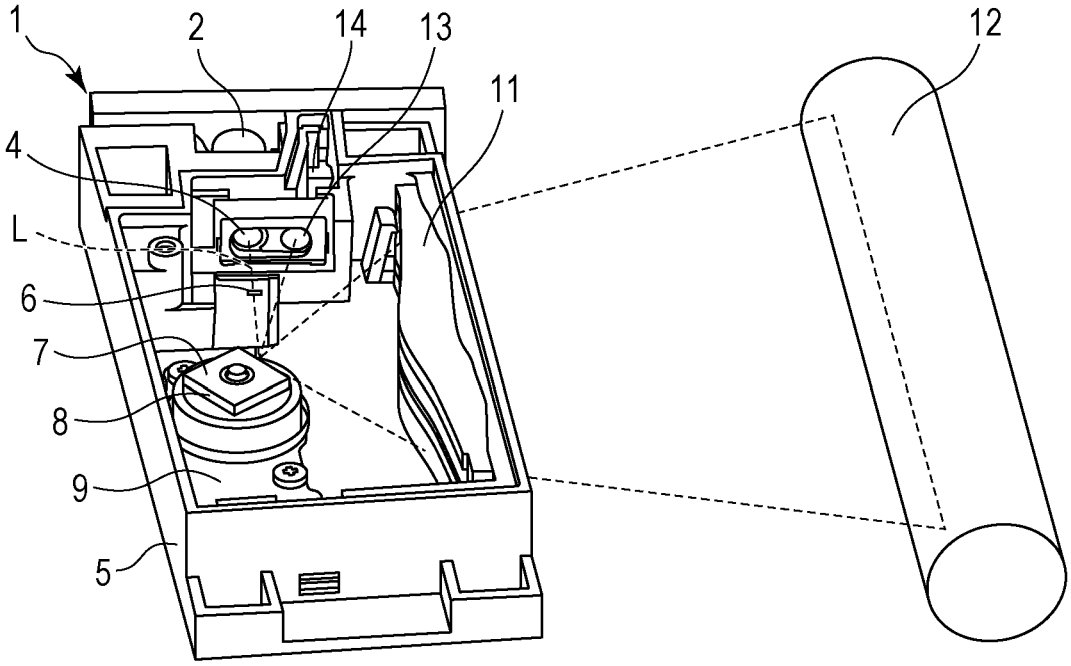
FIG. 2 is a schematic perspective view of an optical scanning device.

FIG. 2 is an illustration for describing an overview of the optical scanning device 1 according to an exemplary embodiment of the present disclosure. A cylindrical lens 4, an optical diaphragm 6, a rotatable polygon mirror 7, and a scanner motor 9 that rotationally drives the rotatable polygon mirror 7 are provided in the stated order in an optical path of a laser beam L emitted from a semiconductor laser unit 2 serving as a light source. The scanner motor 9 is a brushless motor that includes a fluid dynamic bearing.

An fθ lens 11 and the photosensitive drum 12 are provided in an optical path of the laser beam L that has been reflected by the rotatable polygon mirror 7. In addition, an imaging lens 13 and an optical sensor 14 are provided in an optical path of the laser beam L in an area outside an effective image region of the photosensitive drum 12. The optical members described above are housed in an optical box 5, and the optical members are housed in a space that is tightly sealed by the optical box 5, a cover (not illustrated), and so on.

The laser beam L that has been emitted from the semiconductor laser unit 2 in accordance with the image data is steered toward a reflection surface 8 of the rotatable polygon mirror 7 by the cylindrical lens 4 to form a linear image thereon and then reflected by the reflection surface 8. This laser beam L is deflected as the rotatable polygon mirror 7 is rotated by the scanner motor 9, and then strikes the photosensitive drum 12 through the fθ lens 11 to form an image thereon. An imaging spot is moved along the surface of the photosensitive drum 12 in a main scanning direction by rotating the rotatable polygon mirror 7, and thus a scan is carried out. Here, a main scan refers to an operation in which the laser beam L moves along the surface of the photosensitive drum 12 as the rotatable polygon mirror 7 is rotated, and a sub-scan refers to an operation in which the laser beam L moves along the surface of the photosensitive drum 12 as the photosensitive drum 12 is rotationally driven about an axial line of its cylinder. Through the main scan and the sub-scan, a two-dimensional electrostatic latent image is formed on the surface of the photosensitive drum 12.

The function of the optical sensor 14 will now be described. Part of the laser beam L which are not to pass through the fθ lens 11 passes through the imaging lens 13 and is imaged on the optical sensor (BD sensor) 14 serving as a light receiving unit. While the rotatable polygon mirror 7 makes a single rotation, the optical sensor 14 receives the laser beam L the number of times that is equivalent to the number of faces of the rotatable polygon mirror 7 (e.g., four times per rotation in FIG. 4 since the rotatable polygon mirror 7 has four faces) and outputs a pulse signal (BD signal) accordingly. Rotation of the scanner motor 9 and the rotatable polygon mirror 7 is controlled by using the cycle (BD cycle) of the stated pulse signal.

Control of Rotation of Scanner Motor

Figure 3A:
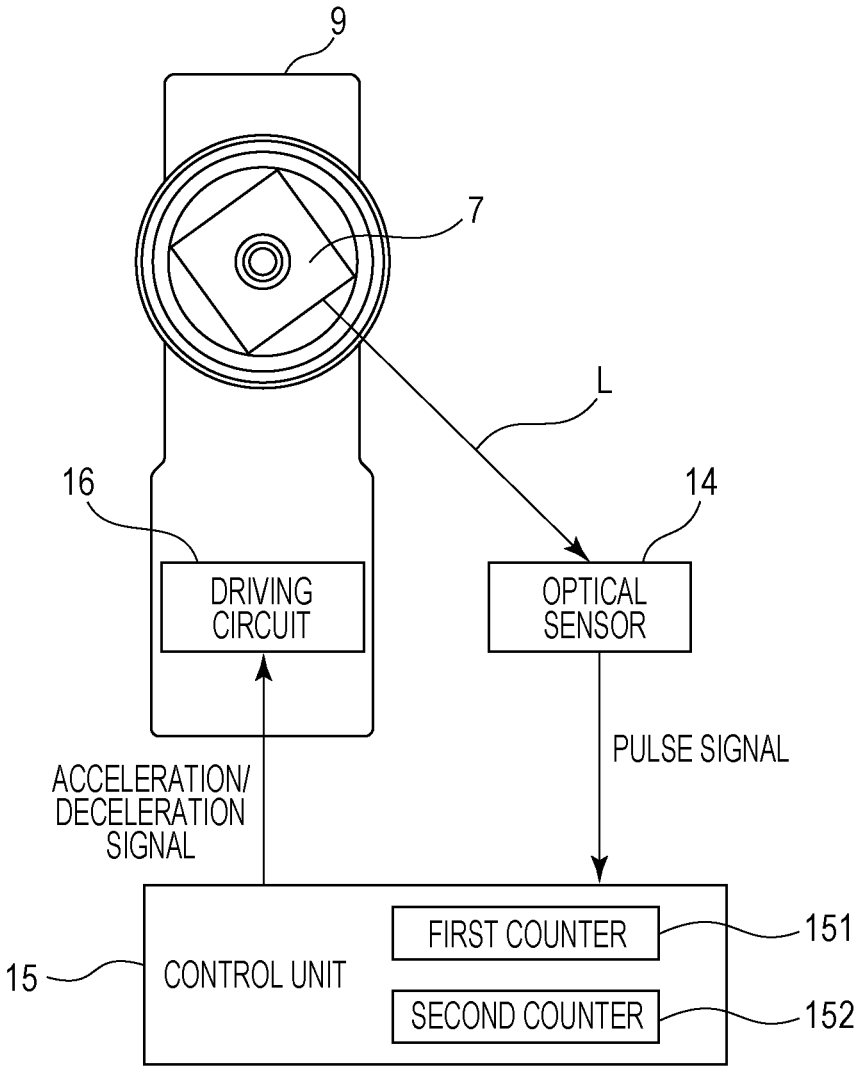
FIG. 3A is an illustration for describing control of a scanner motor.

Control of the rotations of the scanner motor 9 and the rotatable polygon mirror 7 will now be described with reference to FIG. 3A. FIG. 3A is a schematic diagram pertaining to the control of the rotations of the scanner motor 9 and the rotatable polygon mirror 7. The control unit 15 includes a circuit that includes a central processing unit (CPU) or the like for carrying out operations, and carries out various control operations pertaining to the scanner motor 9. The control unit 15 is provided with a first counter 151 and a second counter 152, which will be described later. The control unit 15 detects the cycle of a pulse signal outputted from the optical sensor 14 (hereinafter, simply referred to as "cycle"), and the cycle corresponds to a value related to the number of rotations of the rotatable polygon mirror 7. On the basis of the detected value, the control unit 15 controls the number of rotations of the scanner motor 9 per unit time (hereinafter, simply referred to as "the number of rotations") through a driving circuit 16.

A case in which it is determined that the cycle of the pulse signal is longer than a predetermined cycle indicates that the number of rotations is smaller than a desired number of rotations, and thus the control unit 15 outputs a signal to the driving circuit 16 so as to accelerate the scanner motor 9.

Meanwhile, a case in which it is determined that the cycle of the pulse signal is shorter than the predetermined cycle indicates that the number of rotations is greater than the desired number of rotations, and thus the control unit 15 outputs a signal to the driving circuit 16 so as to decelerate the scanner motor 9. Through such feedback control, the control unit 15 controls the rotatable polygon mirror 7 to rotate at the desired number of rotations. Here, the number of rotations of the rotatable polygon mirror 7 is basically the same as the number of rotations of the scanner motor 9, and thus the description to follow is given with the number of rotations of the scanner motor 9 serving as a reference.

Figure 4A:
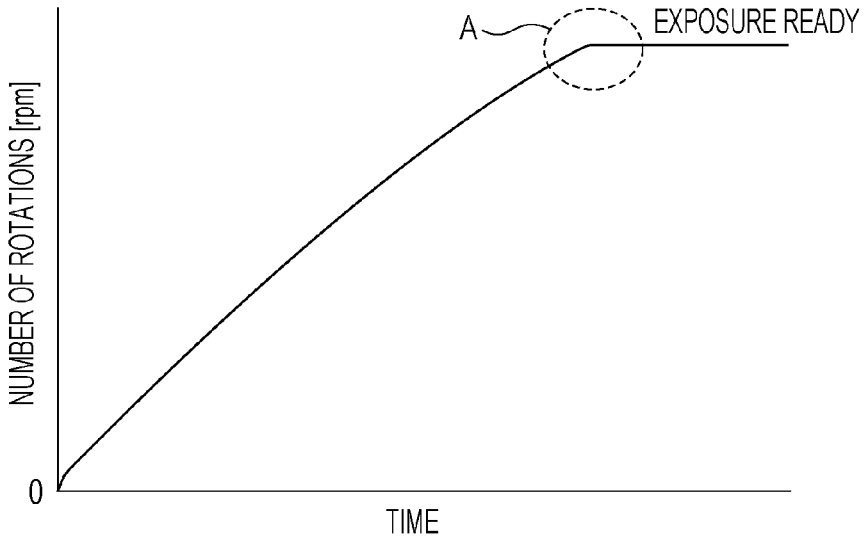
FIG. 4A is a graph indicating a change over time in the number of rotations of a rotatable polygon mirror after the scanner motor is started.
Figure 4B:
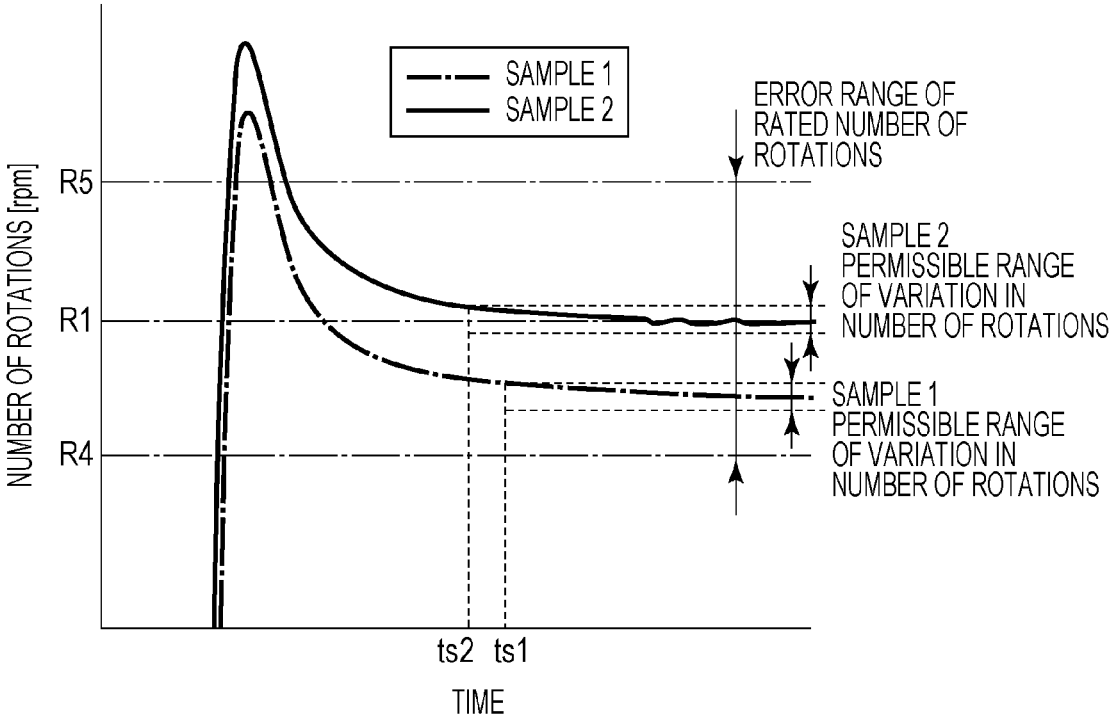
FIG. 4B is an enlarged view of a portion of the graph indicating a change over time in the number of rotations of the rotatable polygon mirror after the scanner motor is started.

FIGS. 4A and 4B are graphs illustrating a change over time in the number of rotations of the rotatable polygon mirror 7 after the scanner motor 9 is started. FIG. 4A illustrates the number of rotations of the scanner motor 9 after the scanner motor 9 starts to be driven until an exposure ready state is achieved. FIG. 4B is an enlarged view of a portion A enclosed by a broken line in FIG. 4A. For convenience of description, in FIG. 4B, waveforms obtained when two rotatable polygon mirrors are started at the same rated number of rotations and then converge are illustrated. Note that the rated number of rotations corresponds to the number of rotations of the scanner motor 9 which has been set in consideration of the number of rotations of the photosensitive drum 12 or the like in accordance with the preset density (i.e., the number of pixels per unit length) of a latent image to be formed on the photosensitive drum 12.

A state in which the scanner motor 9 is in the exposure ready state in the exemplary embodiment corresponds to a state in which the number of rotations of the scanner motor 9 has converged (stabilized) at the number of rotations that allows an image to be formed by emitting a laser beam to write out a latent image on the photosensitive drum 12. To be specific, the number of rotations that allows an image to be formed corresponds to the number of rotations that falls within an error range of the rated number of rotations of the scanner motor 9 (i.e., first range).

The error range of the rated number of rotations will now be described. As illustrated in FIG. 4B, even if the numbers of rotations of scanner motors are made to converge at the same rated number of rotations, the number of rotations at which each of the scanner motors actually converges varies. It is considered that such a variation arises due to individual differences among the scanner motors caused by a component tolerance or the like, individual differences among electric elements in an electronic circuit that includes the control unit 15, the optical sensor 14, and so on for carrying out the above-described feedback control, or quantization errors. The variation occurs typically within a range of approximately ±0.2% (deviation in the number of rotations) of the rated number of rotations R1, and as long as the number of rotations of the scanner motor 9 converges at a predetermined number of rotations within the stated range, an influence on the image quality is substantially negligible. Therefore, in the exemplary embodiment, a lower limit value of the error range of the rated number of rotations is set to the number of rotations that is −0.2% of the rated number of rotations (fourth number of rotations R4), and an upper limit value is set to the number of rotations that is +0.2% of the rated number of rotations (fifth number of rotations R5). Then, in the image forming apparatus 101, the scanner motor 9 that converges at a predetermined number of rotations within the error range of the rated number of rotations (first range) (±0.2% of the rated number of rotations) is employed as a normally working scanner motor. Note that the rated number of rotations is 30000 rpm in the exemplary embodiment, and thus the error range of the rated number of rotations (first range) is from 22940 rpm to 30060 rpm.

Convergence at the predetermined number of rotations will now be described. When a rotational fluctuation (i.e., variation in the speed relative to the predetermined number of rotations) of a scanner motor is large, a variation in the shade appears in the main scanning direction, and thus the image may be degraded in some cases. Therefore, it is necessary to carry out the exposure in a state in which the number of rotations has converged at a level at which the rotational fluctuation (i.e., variation in the speed relative to the predetermined number of rotations) does not affect the image quality. Specifically, the state in which the number of rotations has converged at the predetermined number of rotations refers to a state in which the number of rotations has converged at a level at which the rotational fluctuation (i.e., variation in the rotation speed) does not affect the image quality. To be more specific, such a state is set to a state in which a peak-to-peak value of the variation in the number of rotations falls within 0.02% (=6 rpm) of the rated number of rotations. The scanner motors (sample 1 and sample 2) illustrated in FIG. 4B converge at the predetermined number of rotations that falls within the error range of the rated number of rotations (i.e., the rotational fluctuation falls within a permissible range) at times ts1 and ts2, respectively, and each of the scanner motors thus enters the exposure ready state.

In contrast, in an existing technique, when the scanner motor is started, it is determined that a scanner motor has converged at a predetermined number of rotations that allows an image to be formed on a recording material by waiting for a predetermined period of time after the number of rotations of the scanner motor has reached the predetermined number of rotations. The predetermined period of time in which it is estimated that the rotatable polygon mirror reaches the number of rotations that allows exposure to be performed, however, needs to be set to a period of time with some margins while taking individual differences due to a component tolerance or the like and errors caused by an operating environment into consideration. In addition, an apparatus with such a configuration always waits for the preset period of time after the number of rotations of the rotatable polygon mirror has reached a predetermined value. Thus, there may be a case in which a timing at which the determination of the exposure ready state is made is unnecessarily delayed by waiting for the predetermined period of time while the rotatable polygon mirror has actually converged at the number of rotations that allows the exposure to be performed.

Figure 3B:
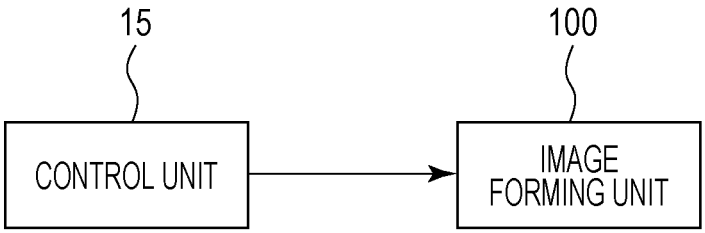
FIG. 3B is an illustration for describing control of an image forming unit.

Here, the image forming unit 100 receives an image forming instruction signal from a host computer, a server, a mobile terminal, or the like (none illustrated) and forms an image on a recording material on the basis of the image forming instruction signal. At this point, in order for the image forming unit 100 to start forming an image on the recording material, it is necessary that mainly the scanner motor 9 has converged at the predetermined number of rotations and is in the exposure ready state (scanner ready) and that the temperature of the fixing unit 107 has reached a temperature that enables fixing (fixing ready). More specifically, as illustrated in FIG. 3B, the control unit 15 makes the determination of the fixing ready state and the determination of the scanner ready state and, on the basis of these determinations, outputs a signal (top signal) that causes image formation to start to the image forming unit 100. Thus, the control unit 15 causes the image forming unit 100 to start an operation of forming an image on the recording material P.

Thus, as described above, if the determination of the scanner ready state is made by waiting for a predetermined period of time while the rotatable polygon mirror has actually converged at the number of rotations that allows exposure to be performed, there may be a case in which the timing at which an image starts to be formed on the recording material is unnecessarily delayed accordingly.

In particular, it does not take much time for the temperature of the fixing unit 107 to reach a temperature that enables fixing, in a case in which much time has not passed since a last instance of image formation and image formation is to be restarted while the temperature of the fixing unit 107 is still relatively high or in a case in which the fixing unit 107 has high temperature adjusting performance in the first place. In particular, in such a case, the determination of the fixing ready state may be made prior to the determination of the scanner ready state being made, and thus the timing at which an image starts to be formed on the recording material may be unnecessarily delayed. Thus, it is desirable that a given configuration allows the timing at which the determination of the scanner ready state to be put forward as much as possible.

Accordingly, in the exemplary embodiment, such a flow of determining the exposure ready state is employed that allows the timing at which the determination of the scanner ready state is made is put forward as compared with that in the existing technique. In the image forming apparatus 101, the control unit 15 executes the flow of determining the exposure ready state described hereinafter and thus determines whether or not the scanner motor 9 has entered the exposure ready state (scanner ready).

Determination Flow of Exposure Ready State

Figure 5:
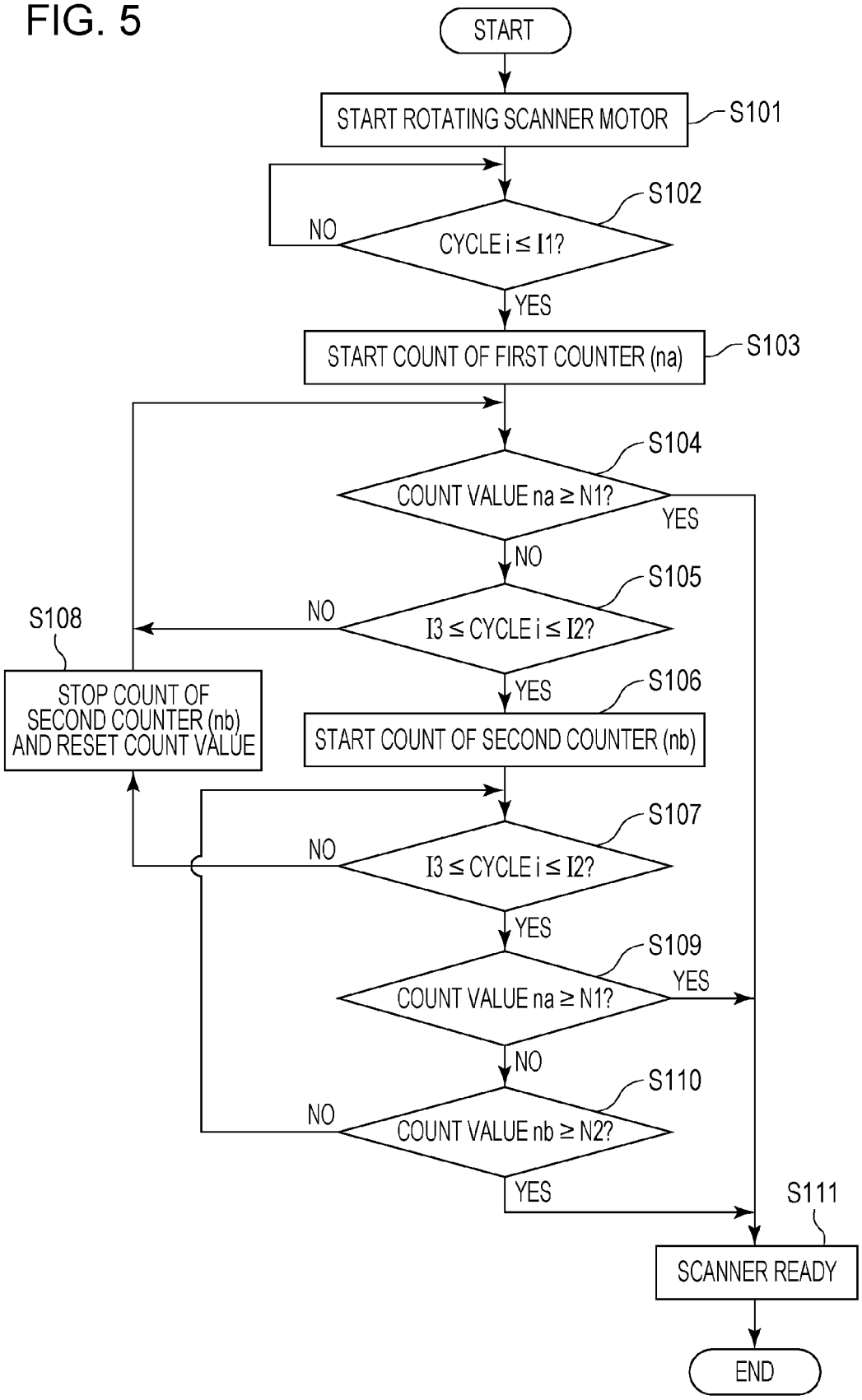
FIG. 5 is a flowchart of scanner motor starting control.

A flow of determination that the scanner motor has converged at the number of rotations that allows exposure to be performed so as to form an image (i.e., the number of rotations that allows an image to be formed) by making a determination of the convergence of the number of rotations of the scanner motor in the exemplary embodiment will now be described. FIG. 5 is a flowchart illustrating starting control of the scanner motor 9. Operations in this flow are executed by the control unit 15.

First, the control unit 15 starts rotating the scanner motor 9 (refer to step 101, which is abbreviated as S101 in FIG. 5, and the same applies to other steps, hereinafter). Then, the control unit 15 monitors the cycle of a signal obtained from the optical sensor 14 and determines whether or not a cycle i of the scanner motor 9 has reached a cycle I1 that corresponds to a predetermined number of rotations (first number of rotations) (i.e., whether or not $i \leq I1$ is satisfied) (S102). The cycle I1 is set to a cycle which the scanner motor 9 always reaches after being started, and the cycle I1 is set to a cycle that corresponds to the rated number of rotations R1 (30000 rpm) in the exemplary embodiment. Upon the cycle i reaching the predetermined cycle I1, the first counter 151 starts a count (S103).

The control unit 15 then determines (detects) whether or not a count value na of the first counter 151 has reached or exceeded N1 (i.e., whether or not $na \geq N1$ is satisfied) (S104). If the condition of $na \geq N1$ is satisfied, the control unit 15 determines that the scanner motor 9 has entered the exposure ready state (scanner ready) (S111). N1 is set to a value that corresponds to a time (first period of time) T1 in which it is estimated that the scanner motor 9 enters the exposure ready state after the cycle reaches I1. Specifically, T1 is a value obtained by adding a delay time (error) ΔT caused by a variation in the operating environment or the component to a time T for the scanner motor 9 to enter the exposure ready state after the cycle reaches I1. In other words, T1 is set to a time having enough margins for the scanner motor 9 to enter the exposure ready state even in a case in which the aforementioned error exists. That is, $T1 \geq T+\Delta T$ (here, ΔT is positive). T1 may take a preset value or a value calculated through a known method on the basis of a change in the number of rotations of the scanner motor 9 after the scanner motor 9 is started. In the exemplary embodiment, T1 is preset to 1.5 sec.

If the condition of $na \geq N1$ is not satisfied in S104, the control unit 15 determines whether or not the number of rotations falls within a second range (S105). Specifically, when a cycle that corresponds to a lower limit value of the second range (second number of rotations R2) is represented by I2 and a cycle that corresponds to an upper limit value of the second range (third number of rotations R3) is represented by I3, in S105, the control unit 15 determines whether or not the cycle i satisfies a condition of $I3 \leq i \leq I2$. In other words, the control unit 15 determines whether or not the number of rotations of the scanner motor 9 is equal to or greater than R2=the second number of rotations and is equal to or less than R3=the third number of rotations. In the exemplary embodiment, the lower limit value of the second range (second number of rotations R2) is set to the number of rotations that is −0.1% of the rated number of rotations R1, and the upper limit value of the second range (third number of rotations R3) is set to the number of rotations that is +0.1% of the rated number of rotations R1. Thus, R2 is 30000×0.999=29970 rpm, and R3=30000×1.001=30030 rpm.

If the condition of $I3 \leq i \leq I2$ is not satisfied in S105, the control unit 15 returns to S104. If the condition of $I3 \leq i \leq I2$ is satisfied in S105, the control unit 15 starts the second counter 152 (S106). The control unit 15 then determines whether or not the number of rotations falls within the second range (i.e., whether or not $I3 \leq i \leq I2$ is satisfied) in a similar manner to that in S105 (S107). If the condition of $I1 \leq i \leq I2$ is not satisfied in S107, or in other words, if the number of rotations falls outside the second range (i.e., $i > I2$, or $i < I3$), the control unit 15 stops the count of the second counter 152 to reset the count value and returns to S104 (S108).

If the condition of $I3 \leq i \leq I2$ is satisfied in S107, the control unit 15 determines (detects) whether or not the count value na of the first counter 151 has reached or exceeded N1 (i.e., whether or not $na \geq N1$ is satisfied) in a similar manner to that in S104 (S109). If the condition of $na \geq N1$ is satisfied, the control unit 15 determines that the scanner motor 9 has entered the exposure ready state (scanner ready) (S111). If the condition of $na \geq N1$ is satisfied, the control unit 15 determines (detects) whether or not a count value nb of the second counter 152 has reached or exceeded N2 (i.e., whether or not $nb \geq N2$ is satisfied) (S110).

The count value N2 is a value that corresponds to a time (second period of time) T2 ($T2 < T1$), and T2 corresponds to 0.3 sec in the exemplary embodiment. Although described later in detail, T2 is set as a time (time with an error taken into consideration) in which it is estimated the rotational fluctuation of the scanner motor 9, which eventually converges at the number of rotations within the second range, falls within the permissible range following the number of rotations entering the second range after the scanner motor 9 is started. In the starting control of the exemplary embodiment, the scanner motor 9 typically overshoots the number of rotations at the lower limit value of the second range (second number of rotations R2) and the number of rotations at the upper limit value (third number of rotations R3) at least once. Thus, T2 is set to the time (time with an error taken into consideration) in which it is estimated that the rotational fluctuation falls within the permissible range following the timing at which the number of rotations reaches or falls below R3 again after the number of rotations has once exceeded R3.

If the condition of nb≥N2 is not satisfied, the control unit 15 returns to S107. If the condition of nb≥N2 is satisfied, that indicates that T2 has elapsed while the number of rotations stays within the second range (i.e., equal to or greater than R2, and equal to or less than R3), and thus the control unit 15 determines that the scanner motor 9 has entered the exposure ready state (scanner ready) (S111).

According to the flow described above, the control unit 15 determines that the scanner motor 9 has entered the scanner ready state at an earlier one of the timing at which T1=the first period of time has elapsed after the number of rotations has reached the first number of rotations R1 (cycle I1) and the timing at which T2=the second period of time has elapsed while the number of rotations stays within the second range.

Figure 8:
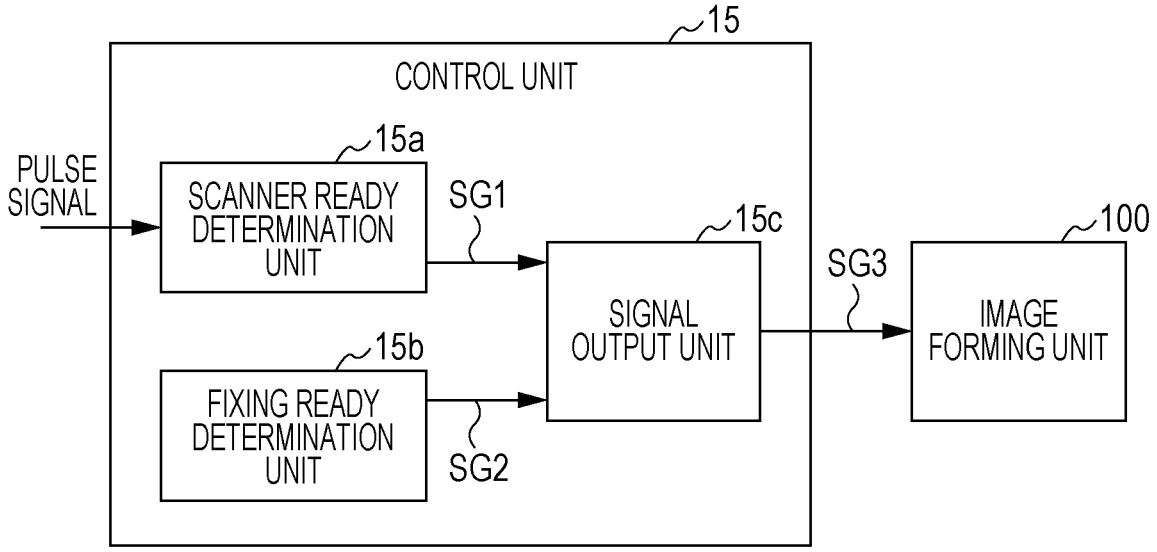
FIG. 8 is an illustration for describing a signal output of a control unit and a configuration for carrying out such processing.

The configuration of the control unit 15 for causing the image forming unit 100 to start forming an image on the recording material P will now be described. FIG. 8 illustrates a configuration for a signal output and processing thereof through which the control unit 15 causes the image forming unit 100 to start forming an image. As described above, the control unit 15 determines whether or not the fixing unit 107 is in the fixing ready state along with making a determination of the scanner ready state. Thus, the control unit 15 includes a scanner ready determination unit 15*a* for making a determination of the scanner ready state and a fixing ready determination unit 15*b* for making a determination of the fixing ready state. The control unit 15 further includes a signal output unit 15*c* that outputs a signal (top signal) to the image forming unit 100 to cause the image forming unit 100 to start forming an image on the basis of outputs from the scanner ready determination unit 15*a* and the fixing ready determination unit 15*b*. The scanner ready determination unit 15*a*, the fixing ready determination unit 15*b*, and the signal output unit 15*c* may include a CPU, a memory, and other electric circuits to be shared there among or may each include a CPU, a memory, and other electric circuits.

The scanner ready determination unit 15*a* includes the first counter 151 and the second counter 152, which have been described above, and accepts input of a pulse signal outputted from the optical sensor 14. The scanner ready determination unit 15*a* executes the above-described determination flow of the exposure ready state so as to determine whether or not the scanner motor 9 is in the scanner ready state. Upon determining that the scanner motor 9 has entered the scanner ready state, the scanner ready determination unit 15*a* immediately outputs a signal SG1 to the signal output unit 15*c*.

The fixing ready determination unit 15*b* determines, through a known flow, whether or not the fixing unit 107 is in the fixing ready state, in which the temperature of the fixing unit 107 has reached a temperature appropriate for forming an image on the recording material. Upon determining that the fixing unit 107 has entered the fixing ready state, the fixing ready determination unit 15*b* immediately outputs a signal SG2 to the signal output unit 15*c*.

Upon receiving both the signal SG1 and the signal SG2, the signal output unit 15*c* outputs a top signal SG3, which is a signal that causes the image forming unit 100 to start forming an image, to the image forming unit 100. For example, in a case in which the signal output unit 15*c* receives the signal SG1 and the signal SG2 in that order, the signal output unit 15*c* waits for the signal SG2 after receiving the signal SG1 and outputs the signal SG3 immediately after receiving the signal SG2. In a case in which the signal output unit 15*c* receives the signal SG2 and the signal SG1 in that order, the signal output unit 15*c* waits for the signal SG1 after receiving the signal SG2 and outputs the signal SG3 immediately after receiving the signal SG1.

In other words, in a case in which the determination of the fixing ready state has already been made at the time when the determination of the scanner ready state is made, the control unit 15 immediately outputs the signal (top signal SG3), which causes image formation to start, to the image forming unit 100 and causes the image forming unit 100 to start the operation of forming an image on the recording material P. Meanwhile, in a case in which the determination of the fixing ready state has not been made at the time when the determination of the scanner ready state is made, the control unit 15 waits for the determination of the fixing ready state and, after such a determination is made, outputs the signal (top signal SG3), which causes image formation to start, to the image forming unit 100 to cause the image forming unit 100 to start the operation of forming an image. Note that T1 is set to a value that corresponds to a time in which it is estimated that the scanner motor 9 enters the exposure ready state after the cycle has reached I1. In a case in which I1 is set as a cycle that corresponds to a small number of rotations that is close to a scanner stop state, the time it takes for the scanner motor 9 to enter the exposure ready state (corresponding to T) increases accordingly. Thus, the delay time (corresponding to the error ΔT) caused by a variation in the operating environment or in the component that needs to be taken into consideration increases as well. Therefore, in order to reduce the error ΔT as much as possible so as to reduce T1, it is preferable that the time it takes for the scanner motor 9 to enter the exposure ready state (corresponding to T) be reduced, and thus it is preferable that the cycle I1 be as close as possible to the cycle that corresponds to the rated number of rotations. If the cycle I1 is set to a cycle that corresponds to the number of rotations that is greater than the rated number of rotations, however, there may be some scanner motors that overshoot but do not reach that number of rotations. Therefore, it is desirable that the cycle I1 be set to a cycle that corresponds to the number of rotations that is equal to or less than the rated number of rotations and is close to the rated number of rotations.

Patterns of Determination of Exposure Ready State

Figure 6:
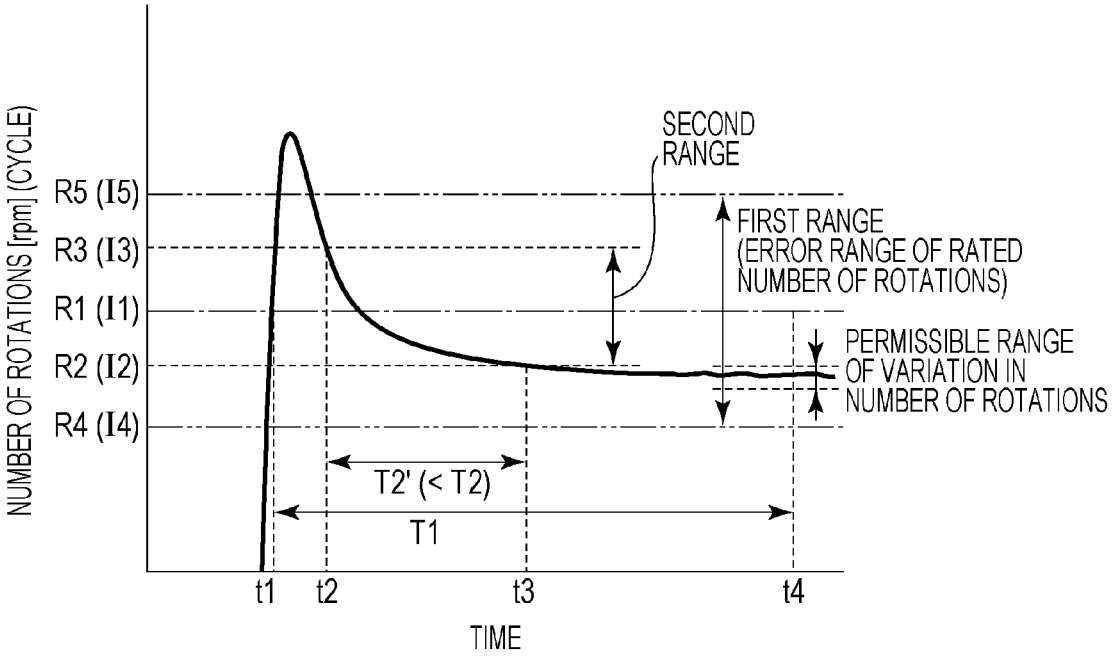
FIG. 6 illustrates a change in the number of rotations after a scanner motor (sample 1) is started.

Two patterns in which it is determined that the scanner motor 9 is in the exposure ready state will now be described and compared. First, a case in which T1 elapses after the number of rotations has reached the first number of rotations (cycle I1) prior to T2 elapsing while the number of rotations stays within the second range will be described. FIG. 6 illustrates a change in the number of rotations around a time at which the sample 1 of the scanner motor 9 illustrated in FIG. 4B enters the exposure ready state. In addition, the origin of the time axis corresponds to a timing at which the scanner motor 9, which is in a rotation stop state, starts to be driven. When the scanner motor 9 reaches the cycle I1 at a time t1, the first counter 151 starts a count. Thereafter, at a time t2, the cycle i enters the second range (I3≤i≤I2), and the second counter 152 starts a count. At a time t3 prior to the count value nb reaching N2, however, the cycle i becomes equal to or greater than I2, and the cycle i falls outside the second range. Here, since t3−t2=T2' (<T2), the count value nb of the second counter 152 is reset. Thereafter, the cycle i converges without entering the second range, and at a time t4, the count value na of the first counter 151 reaches N1. In other words, t4−t1=T1. At this point, the rotational fluctuation of the scanner motor 9 has fallen within the permissible range, and it is determined that the scanner motor 9 has entered the exposure ready state in which the number of rotations has converged at the number of rotations that allows an image to be formed.

Although the second counter 152 starts the count at the time t1 according to the determination flow of the exposure ready state described above, since the number of rotations immediately overshoots to exceed the number of rotations R3 and the count value nb is thus reset, such descriptions are omitted in the preceding descriptions and in FIG. 6.

Figure 7:
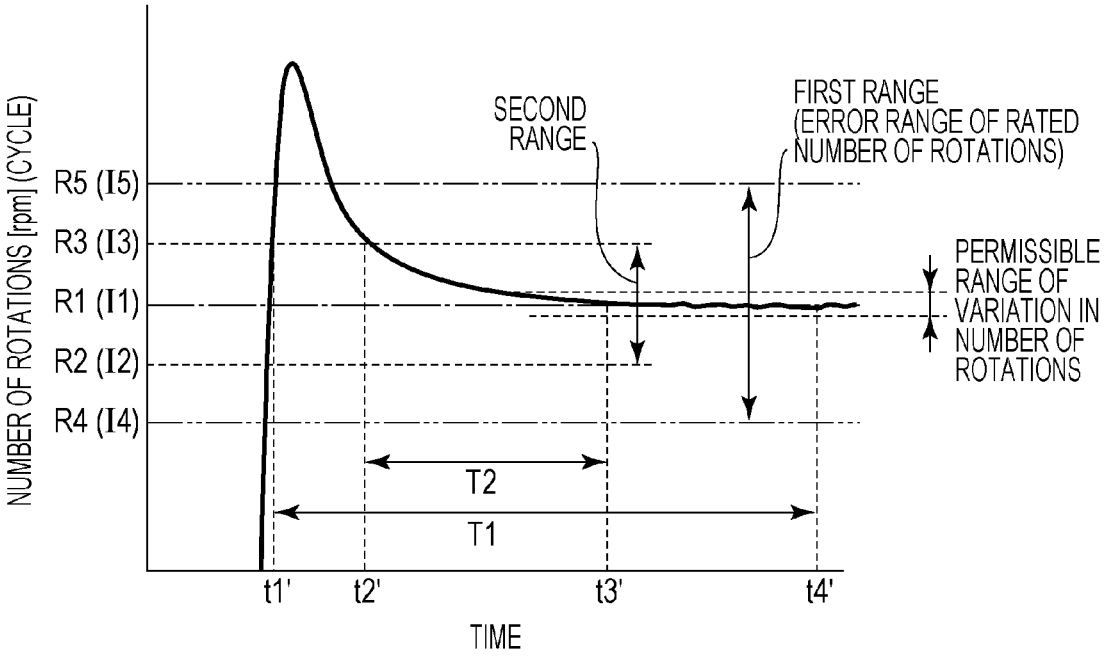
FIG. 7 illustrates a change in the number of rotations after a scanner motor (sample 2) is started.

Subsequently, a case in which T2 elapses while the number of rotations stays within the second range prior to T1 elapsing after the number or rotations has reached the first number of rotations R1 (cycle I1) will be described. FIG. 7 illustrates a change in the number of rotations around a time at which the sample 2 of the scanner motor 9 illustrated in FIG. 4B enters the exposure ready state. In addition, the origin of the time axis corresponds to a timing at which the scanner motor 9, which is in a rotation stop state, starts to be driven. When the cycle i of the scanner motor 9, which has started to be driven, reaches the cycle I1 at a time t1', the first counter 151 starts a count. At a time t2' that comes before the count value na reaches N1, the cycle i enters the second range (I3≤i≤I2), and the second counter 152 starts a count. In the end, the cycle i converges within the second range without ever falling outside the second range, and at a time t3', the count value nb of the second counter 152 reaches N2. In other words, t3−t2=T2. At this point, the rotational fluctuation of the scanner motor 9 has fallen within the permissible range, and it is determined that the scanner motor 9 has entered the exposure ready state in which the number of rotations has converged at the number of rotations that allows an image to be formed. In a case in which the scanner motor 9 starts in such a manner as illustrated in FIG. 7, the count value nb of the second counter 152 reaches N2 at the time t3' prior to the count value na of the first counter 151 reaching N1 at a time t4'. Although the second counter 152 starts the count at the time t1' according to the determination flow of the exposure ready state described above, since the number of rotations immediately overshoots to exceed the number of rotations R3 and the count value nb is thus reset, such descriptions are omitted in the preceding descriptions and in FIG. 7.

In this manner, with the case of the sample 2, the determination of the scanner ready state can be made and an image can start being formed on the recording material P earlier by an amount of time corresponding to the time interval between t4' and t3' than in a case in which the determination of the scanner ready state is made on the basis of only the time that has elapsed after the number of rotations has reached the first number of rotations R1 (cycle I1). In addition, in the case in which the scanner motor 9 starts in such a manner as illustrated in FIG. 7, as compared with the case in which the scanner motor 9 starts in such a manner as illustrated in FIG. 6, the determination of the scanner ready state can be made promptly and an image can start being formed on the recording material P accordingly.

Description of Advantageous Effects

Hereinafter, advantageous effects obtained through the determination flow of the exposure ready state described above will be described. As described above, in the exemplary embodiment, the permissible range of the rated number of rotations is set to a range from −0.2% to +0.2% of the rated number of rotations, and a range from −0.1% to +0.1% of the rated number of rotations is set as the second range. In addition, the time (time with an error taken into consideration) in which it is estimated that, after the scanner motor is started, the rotational fluctuation of the scanner motor, which eventually converges at the number of rotations within the second range, falls within the permissible range following the number of rotations again entering the second range after the number of rotations overshoots the upper limit value R3 of the second range is set as T2. When the second range and T2 are set in such a manner, it has been found through an experiment that T2 can be set sufficiently shorter than T1.

Meanwhile, in a case in which the number of rotations at which the scanner motor converges is normally distributed with a process capability index (Cpk) of 1.33 (value at which it is typically determined that mass production is possible) about the rated number of rotations, 95% or more of normally working scanner motors that converge at the number of rotations within the error range of the rated number of rotations converges at the number of rotations within the second range in the end.

Thus, with scanner motors that converge at the number of rotations within the second range in the end, which account for 95% or more of the normally working scanner motors, T2 elapses while the number of rotations enters the second range and stays within the second range prior to T1 elapsing after the number of rotations has reached R1, as in the sample 2 illustrated in FIG. 7. In other words, with the scanner motors accounting for 95% or more of the normally working scanner motors, the determination of the scanner ready state can be made by satisfying the condition in S110 prior to satisfying the condition in S104 or in S109.

In this manner, according to the exemplary embodiment, with the scanner motors accounting for 95% or more of the normally working scanner motors, the determination timing of the scanner ready state can be put forward as compared with a case of the existing technique in which the determination of the scanner ready state is made by simply waiting for a predetermined period of time after the number of rotations has reached the predetermined number of rotations. As the determination timing of the scanner ready state is put forward, the timing at which an image starts to be formed on the recording material on the basis of the determination of the scanner ready state can be put forward accordingly, and in turn the FPOT can be shortened, making it possible to reduce a user wait time.

Note that the error range (first range) of the rated number of rotations is not limited to the numerical values indicated in the above-described exemplary embodiment and may be set as appropriate in accordance with the types of the scanner motor and the rotatable polygon mirror to be used or other configurations of the image forming apparatus. In addition, the second range is not limited to the numerical values indicated in the above-described exemplary embodiment, either, and may be set as appropriate. Furthermore, the second range does not need to be set to a range with the rated number of rotations being the center. It is, however, necessary that the upper limit value of the second range be less than the upper limit value of the first range and that the lower limit value of the second range be greater than the lower limit value of the first range. In addition, as the second range is wider, T2 needs to be set longer, and thus the timing at which T2 elapses while the number of rotations stays within the second range approaches the timing at which T1 elapses after the number of rotations has reached R1. It is to be noted that, in that case, the advantageous effects of the exemplary embodiment are reduced.

In addition, although the value related to the number of rotations (cycle or the like) of the scanner motor 9 (rotatable polygon mirror 7) has been detected by using the pulse signal outputted from the optical sensor 14, an exemplary embodiment is not limited to such a method. In other words, any known method can be employed, and, for example, the value related to the number of rotations may be detected on the basis of a frequency generation (FG) signal, which is a pulse signal of a frequency in proportion to the number of rotations, outputted from the driving circuit 16 of the scanner motor 9.

While the present disclosure has been described with reference to exemplary embodiments, it is to be understood that the disclosure is not limited to the disclosed exemplary embodiments. The scope of the following claims is to be accorded the broadest interpretation so as to encompass all such modifications and equivalent structures and functions.

What is claimed is:

1. An image forming apparatus for forming an image on a recording material, the image forming apparatus comprising:

an image forming unit including a photosensitive member, a rotatable polygon mirror, and a light source configured to irradiate the polygon mirror with light, the image forming unit being configured to irradiate the photosensitive member with the light reflected by the polygon mirror so as to form a latent image on the photosensitive member and to perform image formation based on the latent image; and a start control unit configured to control start of the image formation on the recording material performed by the image forming unit, the start control unit comprising:

a first detecting unit configured to detect that a preset first period of time has elapsed from when a number of rotations of the polygon mirror reached a first number of rotations; and a second detecting unit configured to detect that a preset second period of time has elapsed while a number of rotations of the polygon mirror is within a range between equal to or more than a second number of rotations and equal to or less than a third number of rotations, wherein, in a case where the second detecting unit detects that the preset second period of time has elapsed before the first detecting unit detects that the first period of time has elapsed, the start control unit causes the image forming unit to start performing image formation on the recording material based on a timing that the preset second period of time elapsed.

2. The image forming apparatus according to claim 1, wherein the preset second period of time is shorter than the preset first period of time.

3. The image forming apparatus according to claim 1, wherein the image forming unit includes a motor that rotates the polygon mirror, and wherein the second number of rotations is less than a preset number of rotations of the motor and the third number of rotations is greater than the preset number of rotations of the motor.

4. The image forming apparatus according to claim 3, wherein the first number of rotations is equal to or less than the preset number of rotations of the motor.

5. The image forming apparatus according to claim 1, wherein, among the numbers of rotations at which the polygon mirror converges, the second number of rotations is greater than a fourth number of rotations and the third number of rotations is less than a fifth number of rotations, the fourth number of rotations being a lower limit value of the number of rotations that allows the image formation to be performed, the fifth number of rotations being an upper limit value of the number of rotations that allows the image formation to be performed.

6. The image forming apparatus according to claim 1, further comprising:

a light receiving unit configured to receive the light reflected by the polygon mirror, wherein the start control unit detects a value that corresponds to the number of rotations of the polygon mirror based on an output from the light receiving unit.

7. The image forming apparatus according to claim 1, wherein the preset first period of time is a period of time that is preset so as to correspond to a period of time in which it is estimated that the polygon mirror reaches the number of rotations that allows the image formation to be performed in a case in which the preset first period of time elapses after the number of rotations of the polygon mirror has reached the first number of rotations.

8. The image forming apparatus according to claim 1, wherein the preset second period of time is a period of time that is preset so as to correspond to a period of time in which it is estimated that the polygon mirror reaches the number of rotations that allows the image formation to be performed in a case in which the preset second period of time elapses while the number of rotations of the polygon mirror stays within a range that is from the second number of rotations inclusive to the third number of rotations.

9. An image forming apparatus for forming an image on a recording material, the image forming apparatus comprising:

an image forming unit including a photosensitive member, a rotatable polygon mirror, and a light source configured to irradiate the polygon mirror with light, the image forming unit being configured to irradiate the photosensitive member with the light reflected by the polygon mirror so as to form a latent image on the photosensitive member and to perform image formation based on the latent image;

a start control unit configured to control start of the image formation on the recording material performed by the image forming unit; and a light receiving unit configured to receive the light reflected by the polygon mirror, wherein the start control unit detects a value that corresponds to a number of rotations of the polygon mirror based on an output from the light receiving unit, and wherein, in a case where before a preset first period of time has elapsed after a number of rotations of the polygon mirror has reached a first number of rotations, and a preset second period of time has elapsed while the number of rotations of the polygon mirror stays within a range that is from a second number of rotations inclusive to a third number of rotations, the start control unit causes the image forming unit to start performing image formation on the recording material based on a timing that the preset second period of time elapsed.

10. The image forming apparatus according to claim 9, wherein the preset second period of time is shorter than the preset first period of time.

11. The image forming apparatus according to claim 9, wherein the image forming unit includes a motor that rotates the polygon mirror, and wherein the second number of rotations is less than a preset number of rotations of the motor and the third number of rotations is greater than the preset number of rotations of the motor.

12. The image forming apparatus according to claim 11, wherein the first number of rotations is equal to or less than the preset number of rotations of the motor.

13. The image forming apparatus according to claim 9, wherein, among the numbers of rotations at which the polygon mirror converges, the second number of rotations is greater than a fourth number of rotations and the third number of rotations is less than a fifth number of rotations, the fourth number of rotations being a lower limit value of the number of rotations that allows the image formation to be performed, the fifth number of rotations being an upper limit value of the number of rotations that allows the image formation to be performed.

14. The image forming apparatus according to claim 9, wherein the preset first period of time is a period of time that is preset so as to correspond to a period of time in which the polygon mirror is estimated to reach the number of rotations that allows the image formation to be performed in a case in which the preset first period of time elapses after the number of rotations of the polygon mirror has reached the first number of rotations.

15. The image forming apparatus according to claim 9, wherein the preset second period of time is a period of time that is preset so as to correspond to a period of time in which the polygon mirror is estimated to reach the number of rotations that allows the image formation to be performed in a case in which the preset second period of time elapses while the number of rotations of the polygon mirror stays within a range that is from the second number of rotations inclusive to the third number of rotations.

* * * * *